US005323546A

United States Patent [19]

Glover et al.

[11] Patent Number: 5,323,546

[45] Date of Patent: Jun. 28, 1994

[54] METHOD OF DRYING PHOTOGRAPHIC MATERIALS

[75] Inventors: Edward C. T. S. Glover, London; Martyn S. Glover, Watford, both of United Kingdom

[73] Assignee: Eastman Kodak Company, Rochester, N.Y.

[21] Appl. No.: 10,263

[22] Filed: Jan. 28, 1993

Related U.S. Application Data

[63] Continuation of Ser. No. 743,345, Aug. 5, 1991, abandoned.

[30] Foreign Application Priority Data

Feb. 10, 1989 [GB] United Kingdom ..... 8903064

[51] Int. Cl.[5] ..... F26B 3/34

[52] U.S. Cl. ..... 34/267; 34/68; 34/421; 34/446; 34/273; 34/549; 34/634

[58] Field of Search ..... 34/17, 41, 48, 50, 18, 34/1, 155, 162, 39, 23, 30, 46, 54, 68

[56] References Cited

U.S. PATENT DOCUMENTS

| | | | |
|---|---|---|---|
| 2,276,448 | 3/1942 | Allen et al. | 34/41 |
| 2,309,993 | 2/1943 | Skagerberg | 34/48 |
| 2,896,058 | 7/1959 | Perryman | 34/48 |
| 3,801,426 | 4/1974 | Putnam et al. | 34/41 |
| 3,864,843 | 2/1975 | Herzhoff et al. | 34/43 |
| 3,900,959 | 8/1975 | Breschi et al. | 34/41 |
| 4,142,301 | 3/1979 | Goodall | 34/18 |
| 4,257,172 | 3/1981 | Townsend | 34/17 |
| 4,616,425 | 10/1986 | Burns | 34/50 |
| 4,660,298 | 4/1987 | Nambu et al. | 34/48 |
| 4,756,091 | 7/1988 | Van Denend | 34/68 |

FOREIGN PATENT DOCUMENTS

| | | |
|---|---|---|
| 1023002 | 1/1958 | Fed. Rep. of Germany . |
| 1561897 | 10/1976 | United Kingdom . |
| 88/08949 | 11/1988 | World Int. Prop. O. . |

OTHER PUBLICATIONS

Patent Abstracts of Japan, vol. 3, No. 93 (M-68), Aug. 8, 1979 and JP,A,5469689 (Mitsubishi Denki K. K.) Jun. 4, 1979.

*Primary Examiner*—Denise Gromada

*Attorney, Agent, or Firm*—Nixon, Hargrave, Devans & Doyle

[57] ABSTRACT

A method for drying photographic materials from an initial moisture content to a desired final moisture content is provided. At least one side of a photographic material having an initial moisture content is heated, with a first heater stage, to achieve an intermediate moisture content in the material. The intermediate moisture content is less than the initial moisture content of the material and greater than the desired final moisture content. The intermediate moisture content of the material is measured and an output signal corresponding to the intermediate moisture content is provided to a control means. The material is then heated with a second heater stage to the desired final moisture content. The second stage heating is controlled using the output signal and the desired final moisture content.

6 Claims, 1 Drawing Sheet

METHOD OF DRYING PHOTOGRAPHIC MATERIALS

This is a continuation of U.S. application Ser. No. 07/743,345, filed on Aug. 5, 1991, now abandoned.

The present invention relates to the drying of materials, particularly, but not exclusively, sheet or web materials such as photographic paper and film.

A number of methods are known for drying photographic paper, for example that shown in British Patent Specification GB-A-1561897. This method involves directing radiant heat only on to the non-image-bearing side of the photographic paper as it travels through a drying chamber and simultaneously causing a stream of air to flow over the image-bearing side of the paper.

When drying photographic paper, it is as important to ensure that the paper is not either over-dried or under-dried. The disclosure of GB-A-1561897 does not in fact indicate that this is a factor to be taken into consideration.

It is therefore an object of the present invention to provide a method and apparatus for ensuring that the material being dried is not over- or under-dried.

According to the present invention, there is provided apparatus for drying a material to a desired final moisture content from an initial moisture content, the apparatus comprising:

heater means for applying heat to at least one side of the material, said heater means comprising a first heater stage and a second heater stage;

sensor means for measuring the moisture content remaining in the material after it has received heat from the first heater stage; and control means for controlling the second heater stage;

characterised in that the first heater stage provides heat to the material at a predetermined fixed level such that an intermediate moisture content is attained which is less than the initial value and greater than the desired final value;

and in that the sensor means provides an output signal to the control means which controls the additional amount of drying required in the second heater stage to attain said desired moisture content.

Advantageously, the heater means comprises at least two heating stages, at least one sensor being positioned between adjacent stages.

Each sensor may be connected to control means which controls power supplied to the heater means.

The apparatus may further comprise blower means for blowing air on to at least one side of the material, and each sensor may be also connected to the control means in order to control the power supplied to the blower means.

Measurement of the moisture remaining in the material can be achieved by any convenient method. In one method, at least one of the sensors may be a capacitance sensor. Alternatively, contact conductive resistance sensors may be used.

Figure 1:
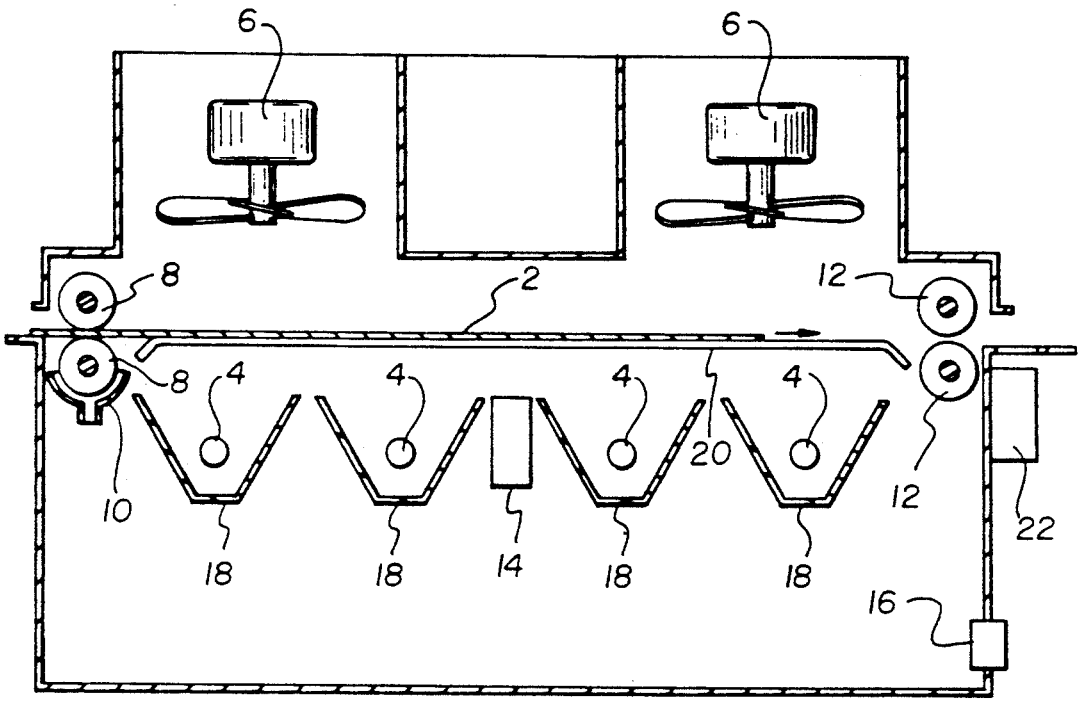
Figure 2:
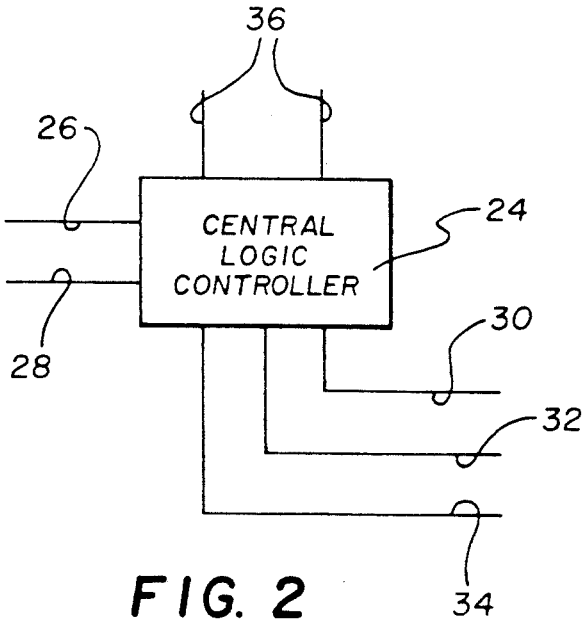

For a better understanding of the present invention, reference will now be made, by way of example only, to the accompanying drawings in which:

FIG. 1 is a side elevation of drying apparatus according to the present invention; and FIG. 2 is a schematic block diagram of a circuit which may be used in controlling the apparatus of FIG. 1.

Although the following description is directed to the drying of photographic paper it is emphasised that it is equally applicable to the drying of any material, particularly in sheet or web form.

FIG. 1 illustrates drying apparatus in which a sheet or web of photographic paper 2 is being dried. The paper 2 passes through the apparatus with its emulsion side uppermost.

Infra-red heaters 4, 4' are positioned below the path of travel of the photographic paper 2, and are arranged in two stages. These heaters 4, 4' are used to heat the wet emulsion layer of the paper, by conduction, through the base on to which the emulsion layer is coated. A reflector 18 is positioned around each heater 4, 4' so that most of the heat generated by the heater is directed upwards on to the base of the photographic paper 2.

At the same time as heat is applied to the paper 2 through its base, unheated air is blown on to the emulsion side of the paper 2 by fans 6. This enables water vapour released from the surface of the paper 2 to be carried away.

Squeegee rollers 8 are provided at the entry to the apparatus, the paper 2 entering the apparatus between these rollers. The rollers 8 remove surface water which then passes out through a drain outlet 10.

Transport rollers 12 are provided at the exit from the apparatus. These rollers 12 direct the dried paper 2 on to further processing stages, for example, to cutting apparatus which cuts the paper into individual prints.

The squeegee rollers 8 and transport rollers 12 are driven (by means not shown) so as to direct the paper 2 into and out of the drying apparatus.

A sensor 14 is positioned halfway along the path which the paper 2 takes through the drying apparatus, that is between heater stages 4 and 4.40 . The sensor 14 senses the amount of moisture left in the paper 2 as it passes that sensor (after passing through heaters 4). The sensor 14 uses a proportional capacitance technique to determine the amount of moisture remaining the paper.

From the measurements made by the sensor 14, the power supplied to the heaters 4' which follow sensor 14 (in the direction of travel of the paper) is controlled so as to, in turn, control the amount of further drying that takes place.

Although only one sensor 14 is shown after the first two heaters 4, further sensors could be provided at that position if desired.

A fan 16 circulates air in the space 40 to provide a small quantity of cooling air for the sensor 14 and the backs of reflectors 18.

Wire guides 20 are provided to ensure that the paper 2 is transported across the heaters 4, 4' to the transport rollers 12.

A sensor 22 is positioned after the transport rollers 12 so as to provide a final check on the amount of moisture in the paper 2 as it leaves the apparatus.

A circuit which may be used to control the apparatus of FIG. 1. is shown in FIG. 2. The circuit comprises a central logic controller 24 which has inputs 26 and 28 from the sensors 14 and 22 (not shown), and outputs 30, 32, 34 and 36 which are connected to the fans 6, fan 16, transport rollers 12 and heater 4, 4' respectively (also not shown).

The present invention has the advantage that the power consumption is minimised and the danger of overheating the paper is avoided. Also, the amount of drying is controlled independently of the temperature or humidity of the air being used to dry the material.

When the present invention is used in a dryer which operates with infra-red radiation and unheated air, it is very fast. In particular, a high level of power can be applied at the initial stage and then the need for any further drying determined as described above.

The present invention can be used in processing machines to dry coated exposed and processed material. It can also be used in drying any web or material, for example in coating operations, or in drying chemical solids out f solutions or other materials.

Although in the above described arrangement, use is made of non-contacting heater, contact heating using a hot surface can also be employed where appropriate. For example, the wire guides 20 in contact with the base of the paper could be heated directly. Furthermore, recycled hot air can also be employed.

Capacitance sensing is the preferred arrangement, although contact conductive resistance sensing can also be used.

Other heating arrangements could also be employed, for example those using infra-red or microwave radiation.

Although as described above the arrangement utilises heating the material from one side and blowing air from the other side, it is emphasised that any other suitable arrangement could be used as long as the material is heated from at least one side. For example, both the heating and the blowing of air could be on the same side of the material. The material could be heated from more than one side. Similarly, the air could be blown from more than one side.

Although as described above, the paper can pass through two heating stages, it is emphasised that any suitable number of heating stages can be employed as desired.

Furthermore, as an alternative to the heating stages being provided by physically successive heaters, they could be provided by the paper being exposed to the same heaters more than once by recycling the paper through the same heaters.

The arrangement described above has the added advantage that is can be used under any climatic conditions without requiring further adjustment. Naturally, adjustment will need to be made to accommodate materials having different physical characteristics.

We claim:

1. A method for drying photographic material from an initial moisture content to a desired final moisture content, comprising:

providing a photographic material having an initial moisture content;

heating, with a first heater stage, at least one side of said photographic material to achieve an intermediate moisture content in said material, said intermediate moisture content being less than the initial moisture content and greater than the desired final moisture content;

measuring the intermediate moisture content of said material;

providing an output signal corresponding to said intermediate moisture content to a control means; and heating the photographic material having the intermediate moisture content with a second heater stage to dry the photographic material to said desired final moisture content, wherein said heating with the second heater stage is controlled using said output signal and said desired final moisture content.

2. The method of claim 1, wherein said material is in sheet or web form.

3. The method of claim 2, wherein said photographic sheet material is photographic film.

4. The method of claim 2, wherein said photographic sheet material is photographic paper.

5. The method of claim 1, further comprising blowing air on to at least one side of the material.

6. A method according to claim 1, wherein said heating with the second heater stage utilizes blown air.

* * * * *